US005235329A

United States Patent [19]

Jackson

[11] Patent Number: 5,235,329

[45] Date of Patent: Aug. 10, 1993

[54] EMERGENCY VEHICLE DETECTION DEVICE

[75] Inventor: LeGrant Jackson, Tempe, Ariz.

[73] Assignee: E A S Emergency Alert Systems, Inc., Tempe, Ariz.

[21] Appl. No.: 769,237

[22] Filed: Oct. 1, 1991

[51] Int. Cl.[5] ..... G08G 1/00

[52] U.S. Cl. ..... 340/902; 340/903; 340/904; 340/906; 455/34.1; 455/34.2; 455/54.2

[58] Field of Search ..... 340/902, 903, 904, 906; 455/34.1, 34.2, 54.2

[56] References Cited

U.S. PATENT DOCUMENTS

| | | | |
|---|---|---|---|
| 3,673,560 | 6/1972 | Barsh et al. | 340/902 |
| 3,772,641 | 11/1973 | Grosser et al. | 340/901 |
| 3,784,970 | 1/1974 | Simpkin | 340/906 |
| 4,216,545 | 8/1980 | Flickshu et al. | 340/904 |
| 4,443,790 | 4/1984 | Bishop | 340/902 |
| 4,794,394 | 12/1988 | Halstead | 340/903 |
| 5,091,906 | 2/1992 | Reed et al. | 455/54.2 |

*Primary Examiner*—Jin F. Ng
*Assistant Examiner*—Nina Tong
*Attorney, Agent, or Firm*—Glen R. Grunewald

[57] ABSTRACT

A combination to detect the proximity of an emergency vehicle including a transmitter in the emergency vehicle and a receiver in another vehicle, the receiver actuating an alarm such as a blinking light upon the reception of a transmission from an emergency vehicle.

8 Claims, 1 Drawing Sheet

EMERGENCY VEHICLE DETECTION DEVICE

TECHNICAL FIELD

This invention is in the field of devices for detecting the presence or approach of an emergency vehicle.

BACKGROUND ART

Emergency vehicles use sirens and flashing lights to warn other drivers of their approach or of their presence. There are many reasons why sirens and flashing lights do not provide adequate warnings. Flashing lights can only be seen where there is a direct line of sight and cannot be seen around corners in built-up metropolitan areas. Sirens cannot heard by people who are hard of hearing or in vehicles where there is competing noise, such as a loud radio or noisy machinery or a different emergency vehicle that has its siren on. Frequent collisions between emergency vehicles and other vehicles or even between two emergency vehicles responding to a call indicate that a siren or flashing lights alone are not adequate to warn all drivers of the presence or approach of the emergency vehicle. The consequences of a driver straying into the path of a rapidly moving emergency vehicle are so severe that there is a need for some additional way to warn drivers of the presence or approach of an emergency vehicle.

DISCLOSURE OF THE INVENTION

In accordance with this invention an emergency vehicle is equipped with a device to transmit a wave-born signal that can be sensed by a receiver in another vehicle that is sensitive to the frequency of the wave-born signal and is connected to means to actuate an alarm in the receiving vehicle to warn the driver of the receiving vehicle unambiguously that an emergency vehicle responding to a call is in the vicinity or is approaching.

In its most direct form, an emergency vehicle will transmit a wave-born signal when it is responding to an emergency. One suitable transmitter is the siren with which the vehicle is already equipped. The receiving vehicle, for example an ordinary automobile driven by someone who is hearing impaired or by someone who is surrounded by loud noises, includes a receiver that is sensitive to one or more frequencies emitted by the siren and that receiver in turn is connected to actuate an audible or visible alarm in the receiver vehicle. An audible alarm could be a beeper having a volume audible above background noise or of a significantly different frequency from the background noise. The preferred alarm is a visible alarm such as a blinking light mounted to be visible on the dashboard or above the windshield or involved with circuitry that would cause the dome light of an automobile or the map light of an automobile to start blinking when the transmitter senses a wave-born transmission at a frequency to which it is sensitive.

In another preferred form of the invention the transmitting vehicle is provided with a transmitter for a radio signal that is actuated contemporaneously with the actuation of a siren so that the receiving vehicle may receive an inaudible signal to activate the alarm. Preferably the radio signal will be a short-range signal in the citizen's band frequency. Usually the range of the transmission will be limited to about 500 meters.

This invention also includes the use of a receiver in an emergency vehicle to indicate the presence of another responding emergency vehicle. This embodiment is particularly useful because the siren of one emergency vehicle will prevent hearing the siren of a different emergency vehicle. In accordance with this embodiment of the invention an emergency vehicle is equipped with a receiver that is sensitive to a frequency that is not transmitted by its own transmitter. The preferred form of this embodiment is to have each receiver sensitive to only a single frequency or at most a very narrow range of frequencies and to have the transmitter of that vehicle transmit in a broad band of frequencies but not at the single frequency or the narrow band of frequencies to which its own receiver is sensitive. As an example of this embodiment, a transmitter may transmit at all frequencies between 463 and 469 MHz except 464.53 which is the frequency to which its receiver is tuned. This can be accomplished by the transmitting vehicle having two transmitters, one transmitting at all frequencies between 463 and 464.4 MHz and one transmitting at all frequencies between 464.45 and 469 MHz. Using this embodiment, each emergency vehicle in a fleet of emergency vehicles is able to transmit a signal to every vehicle in the fleet except itself. The receiver in the transmitting vehicle may be in a circuit to automatically be actuated by turning the ignition key to the on position whereby the vehicle is capable of sensing the approach or the presence of an emergency vehicle any time it is in use.

BEST MODE FOR CARRYING OUT THE INVENTION

Figure 1:
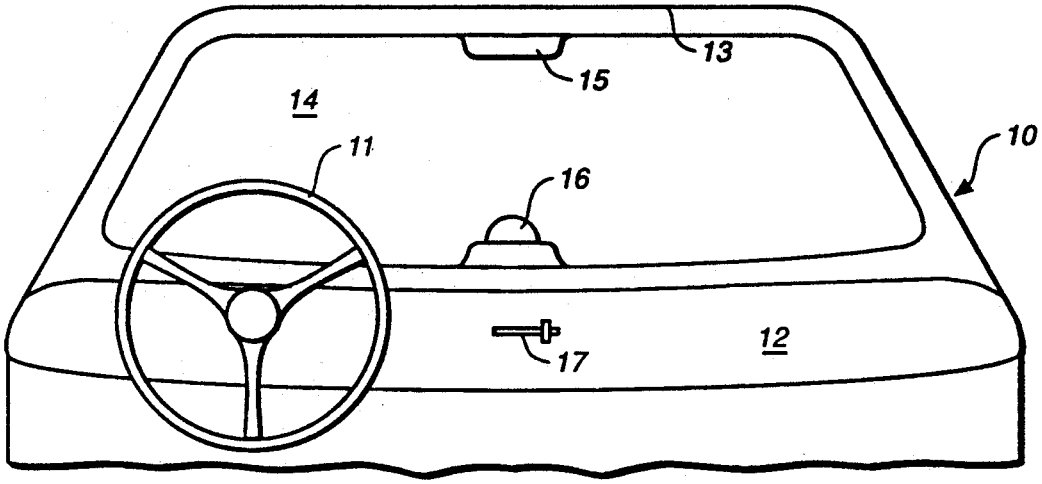
FIG. 1 is a partial schematic drawing of the interior of a vehicle, looking forward from the back seat, the vehicle being equipped with the device of this invention.

FIG. 1 schematically illustrates the interior of an automobile equipped with the device embodying this invention shown without the driver or front passenger's seat. The interior illustrated in FIG. 1 includes a steering wheel 11, a dash board 12 (shown without any instruments or glove compartments), a ceiling 13 and a windshield 14. The automobile illustrated in FIG. 1 includes a dome light or map light illustrated at 15 and a visible signal device 16 which in a preferred embodiment is a red light that blinks when it is activated. The dash board 12 includes an off-on switch 17 to activate the transmitter. The interior shown in FIG. 1 is typically an emergency vehicle equipped to transmit a signal to warn other vehicles of its approach and to receive a signal to indicate the approach of other similarly equipped vehicles.

Figure 2:
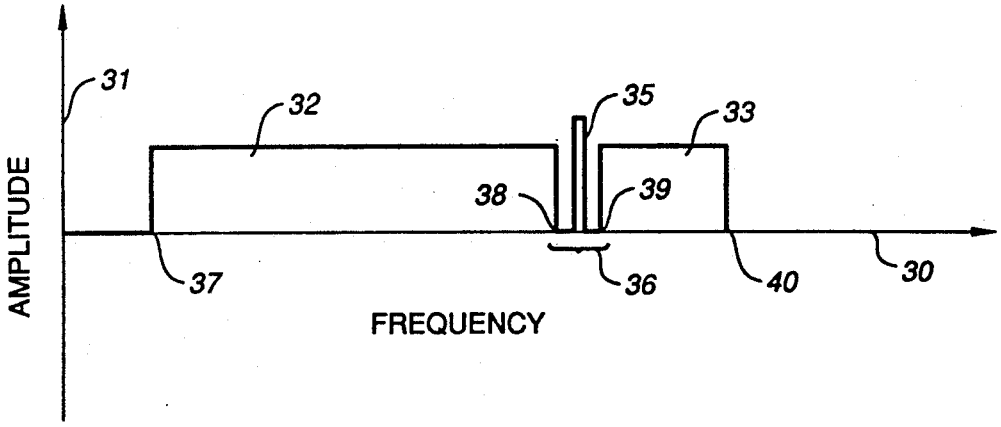
FIG. 2 is a graphical representation of a relationship between transmitting and receiving frequencies that may be used with a particular emergency vehicle equipped with the device of this invention.

Upon activation of switch 17 radio transmissions, preferably in the citizen's band and preferably strong enough only to be received at a distance of approximately 500 meters from the transmitter, are broadcast. As illustrated in FIG. 2, either a single transmitter that will transmit at two different frequency bands or two transmitters each of which transmit at its own frequency band are shown. The area 32 illustrates a broad band transmission between frequency 37 and frequency 38 while area 33 illustrates a broad band frequency transmission between frequencies 39 and 40. 36 indicates a transmission dead band, that is a frequency band in which there are no transmissions. The receiver in the vehicle is tuned to receive transmissions in the narrow band of reception illustrated by frequencies in region 35.

Exemplary of the utility of the device of this invention is a situation in which the vehicle illustrated in FIG. 1, an emergency vehicle is called to respond to an emergency. At the time switch 17 is turned on to actuate the siren the transmitting equipment to transmit frequencies in regions between frequencies 37 and 38 and in the regions between frequencies 39 and 40 is also actuated and these transmissions will be received by appropriate receivers which are tuned to receive frequencies in those broad bands of transmissions. However, the receiver of the vehicle 10 is tuned to receive frequencies in the narrow band 35 which is located in the dead band 36 of the transmission equipment and therefor the flasher 16, or the dome light 15 if it is in circuit to be flashed are not actuated by the transmitters in the vehicle 10. Accordingly, if the dome light 15 flashes or if emergency flasher 16 flashes the occupants of vehicle 10 will know that a different emergency vehicle is within 500 meters and may be approaching so that special care must be exercised in approaching blind corners or the like.

I claim:

1. A device to detect the proximity of a first vehicle to a second vehicle comprising a transmitter of a wave-carried signal in said first vehicle, said signal being in two broad frequency bands separated by a dead zone between said bands, a receiver for said wave-carried signal in said second vehicle, alarm means in said second vehicle, means associated with said receiver to actuate said alarm means when a wave-carried signal is received in said second vehicle, a receiver in said first vehicle for receiving a signal having a frequency in said dead zone transmitted by the second vehicle.

2. The device of claim 1 wherein said wave-carried signal is a radio signal.

3. The device of claim 2 wherein said radio signal is carried in a citizen's band frequency.

4. The device of claim 1 wherein said wave-carried signal carries less than approximately 500 meters.

5. The device of claim 1 wherein said alarm is visible.

6. The device of claim 5 wherein said alarm comprises a flashing light.

7. The device of claim 6 wherein said flashing light is a dome light located in said vehicle.

8. The device of claim 1 wherein said alarm comprises an audible sound.

* * * * *